US006054805A

United States Patent [19]

Park et al.

[11] Patent Number: 6,054,805

[45] Date of Patent: Apr. 25, 2000

[54] CATHODE RAY TUBE AND METHOD OF MANUFACTURING SAME

[75] Inventors: Won-sueg Park; In-kyu Park, both of Kyungki-do; Chul-han Bae, Seoul, all of Rep. of Korea

[73] Assignee: Samsung Display Devices Co., Ltd., Kyungki-do, Rep. of Korea

[21] Appl. No.: 09/036,472

[22] Filed: Mar. 6, 1998

[30] Foreign Application Priority Data

Apr. 14, 1997 [KR] Rep. of Korea ..... 97-13646

[51] Int. Cl.[7] ..... H01R 13/46; H01J 31/00

[52] U.S. Cl. ..... 313/477 R; 313/477 HC; 313/313.05; 313/318.01

[58] Field of Search ..... 313/477 R, 477 HC, 313/318.01, 318.05, 318.06, 51, 318.08, 482; 445/24, 25

[56] References Cited

U.S. PATENT DOCUMENTS 4,040,707 8/1977 Pisano ..... 313/318.05

5,818,155 10/1998 Kawamura et al. ..... 313/318.05

FOREIGN PATENT DOCUMENTS 8-83582 3/1996 Japan ..... 313/318.05

*Primary Examiner*—Nimeshkumar D. Patel
*Assistant Examiner*—Joseph Williams
*Attorney, Agent, or Firm*—Christie, Parker & Hale, LLP

[57] ABSTRACT

A method of manufacturing a cathode ray tube includes the steps of providing a stem with a flange having an outer diameter smaller than an inner diameter of a bottom end of the neck, performing a sealing operation between the stem and the neck in such a state that a bottom side of the flange is in a position, externally distant from the bottom end of the neck less than a thickness (mm) of the flange while internally distant from it less than twice the thickness of the flange, and moving the stem downward during the sealing operation so as to elongate the sealed portion of the neck, thereby preventing it from being deflated.

14 Claims, 7 Drawing Sheets

CATHODE RAY TUBE AND METHOD OF MANUFACTURING SAME

CROSS REFERENCE TO RELATED APPLICATION

This application is based on application No. 97-13646 filed in Korean Industrial Property Office on Apr. 14, 1997, the content of which is incorporated hereinto by reference.

BACKGROUND OF THE INVENTION (a) Field of the Invention

The present invention relates to a cathode ray tube (CRT) and a method of manufacturing the same and, more particularly, to a CRT manufacturing method which removes one of the serious defects generated in the CRT manufacturing process, called a beam-guide hole clogging defect of a shadow mask and prevents deterioration of the electron emission deficiency of an electron gun and occurrence of a crack while reducing the number of the CRT processing steps.

(b) Description of the Related Art

Generally, CRTs are designed to reproduce the original picture image on a glass screen through receiving the picture image signals from the external and exciting phosphors coated on the screen with electron beams emitted from the electron gun in accordance with the signals.

FIG. 8 is a schematic cross sectional view of the generally well-known CRT. As shown in the figure, the CRT usually includes a panel 4 having a phosphor screen 2, a funnel 8 bonded together with the panel 4 in a vacuum-tight manner and mounting a deflection unit 6 thereon, and a neck 12 connected to the funnel 8 in the rear to accommodate an electron gun 10 therein.

The electron gun 10 is mounted on a stem 14 to receive current for emitting, focusing and accelerating thermal electrons from it. The stem 14 is fitted into the neck 12 in such a manner as to provide a vacuum-tight seal between them.

A conventional method of sealing the stem to the neck will be now described with reference to FIG. 7.

FIG. 7 is a cross sectional view of a neck 12 and stem S before performing a sealing operation. As shown in the figure, the sealing operation is performed in such a state that the stem S is deeply inserted into the inside of the neck 12. At this state, the lateral surface of the neck 12 adjacent to a flange of the stem S is heated using torches T till it is fused to thereby provide a seal together with the stem S, and the remaining end portion of the neck 12 is removed and waste-disposed.

However, when the end portion of the neck N is cut off or drops to be thereby broken to pieces, a fine glass powder is generated.

The glass powder wanders through the factory and intrudes into the inside of the CRT through the exhaust pipe externally attached to the stem or through the opening portion of the neck before the sealing operation so that it clogs beam-guide holes formed on the shadow mask. This causes a serious defect in the CRT processing, called a beam-guide hole clogging defect.

Furthermore, since the remaining end portion of the neck is cut off and waste-disposed after the sealing operation, a minus effect is resulted in the production costs.

In the meantime, another conventional method of sealing the stem to the neck is disclosed in a Japanese Patent No. 8-83582. In the method, the sealing operation is performed in such a state that the bottom end of the neck is positioned on the upper portion of the stem flange.

Meanwhile, in order to provide a vacuum-tight seal between the neck and stem at that state, the bottom end of the neck should uniformly contact the upper portion of the flange. However, such an uniform contact cannot be practically obtained because an error may be occurred in fixing the neck on a predetermined position. Moreover, the end portion of the neck as well as the upper portion of the flange may not be even.

Accordingly, there is always a gap between the bottom end of the neck and the upper portion of the flange due to their rough contact. And when the heating operation is performed onto the gapped contact side by the heating element such as a torch, the torch flame penetrates into the inside of the neck through the gap. As a result, the electrodes of the electron gun and the stem pins are oxidized so that the electron emission efficiency is deteriorated.

Furthermore, it is required that an additional step of moving the stem toward the neck should be added to provide a vacuum-tight seal between the stem and neck by removing the gap therebetween.

Moreover, since the end portion of the neck should be fused on the upper portion of the stem flange, the fused portion may contact protrusions of the stem pins, thereby causing a crack.

SUMMARY OF THE INVENTION

Accordingly, the present invention is directed to a CRT and method of manufacturing the same which substantially obviates one or more of the problems due to limitations and disadvantages of the related art.

An object of the present invention is to provide a CRT and method of manufacturing the same which removes one of the serious defects generated in the CRT manufacturing process, called a beam-guide hole clogging defect of a shadow mask and prevents deterioration of the electron emission deficiency of an electron gun and occurrence of a crack while reducing the number of the CRT processing steps.

Additional features and advantages of the invention will be set forth in the description which follows, and in part will be apparent from the description, or may be learned by practice of the invention. The objects and other advantages of the invention will be realized and attained by the structure particularly pointed out in the written description and claims hereof as well as the appended drawings.

To accomplish these and other advantages, the CRT includes a panel having a phosphor screen, a funnel bonded together with the panel in a vacuum-tight manner, a neck connected to the funnel in the rear, and a stem mounting an electron gun thereon and having a flange, the flange being sealed to the neck, wherein a bottom end of the neck has an inner diameter larger than an outer diameter of the flange, and a sealing operation between the neck and the flange is performed in such a state that a bottom side of the flange is in a position, externally distant from the bottom end of the neck less than a thickness of the flange while internally distant from it twice the thickness of the flange.

The CRT manufacturing method includes the steps of providing a stem with a flange having an outer diameter smaller than an inner diameter of a bottom end of the neck, performing a sealing operation between the stem and the neck in such a state that a bottom side of the flange is in a position, externally distant from the bottom end of the neck less than a thickness of the flange while internally distant from it less than twice the thickness of the flange, and moving the stem downward during the sealing operation so as to elongate the sealing portion of the neck, thereby preventing it from being deflated.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate a particular embodiment of the invention and, together with the description, serve to explain the principles of the invention. In the drawings.

DETAILED DESCRIPTION OF THE INVENTION

Reference will now be made in detail to the preferred embodiments of the present invention, examples of which are illustrated in the accompanying drawings.

Figure 1A:
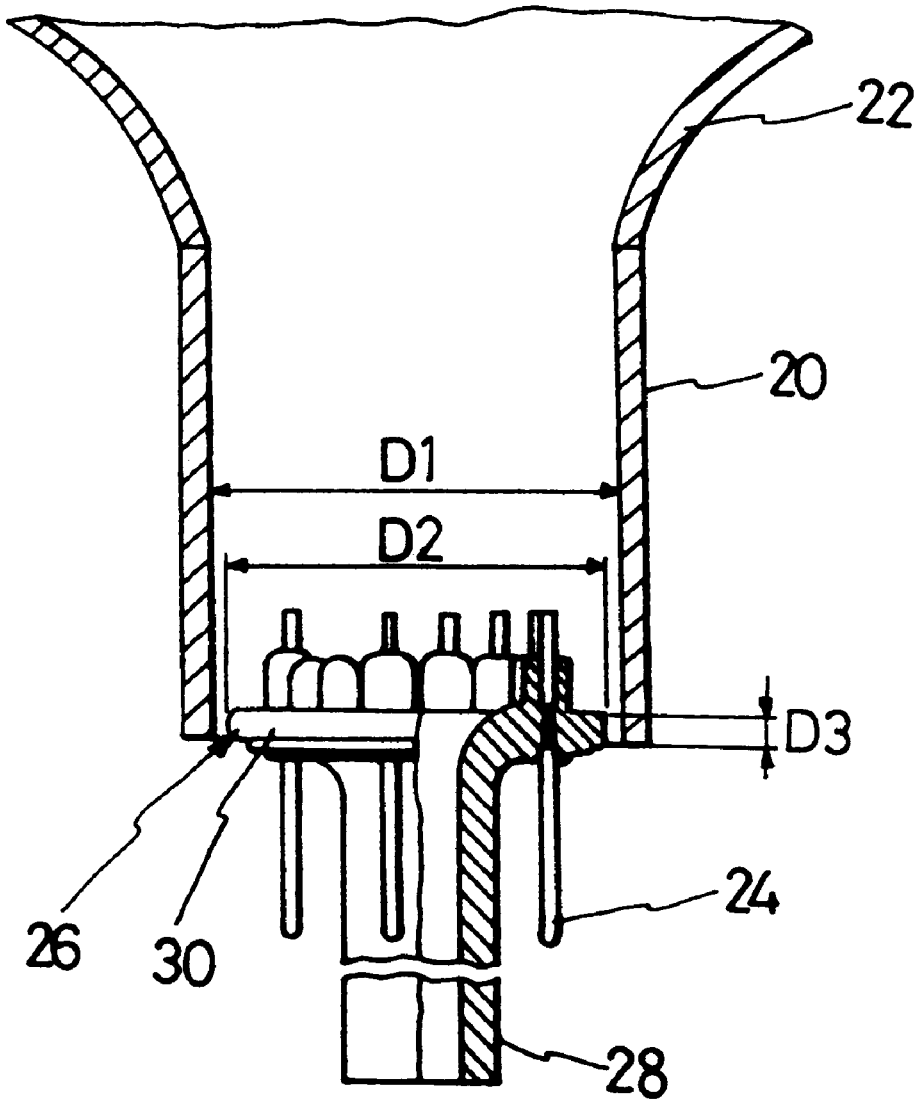
FIG. 1A is a cross sectional view of a neck and stem of the CRT before performing a sealing operation according to a first preferred embodiment of the present invention.

FIG. 1A is a cross sectional view of a neck and stem of the CRT according to a first preferred embodiment of the present invention. In this preferred embodiment, the neck 20 has an uniform inner diameter D1 all the way from its top end to the bottom end and the stem 26 has a flange 30 to be sealed to the neck 20.

The stem 26 is provided with a plurality of pins 24 for supplying current to an electron gun (not shown). The stem 26 has an outer diameter D2 smaller than the inner diameter D1 of the neck 20 so that the stem 26 can be fitted into the inside of the neck 20.

The stem 26 is further provided with an exhaust pipe 28 externally connected thereto to exhaust air from the inside of the CRT to the outside.

As the stem 26 is fitted into the inside of the neck 20, a bottom side of the flange 30 is placed in a position, externally distant from the bottom end of the neck 20 less than a thickness D3 of the flange 30 while internally distant from it less than twice the thickness. The thickness of the currently available stem flanges is in a range of 1.5~3.0 mm although it can be more or less varied in accordance with a dimension of the CRT or due to a flange processing error.

Figure 1B:
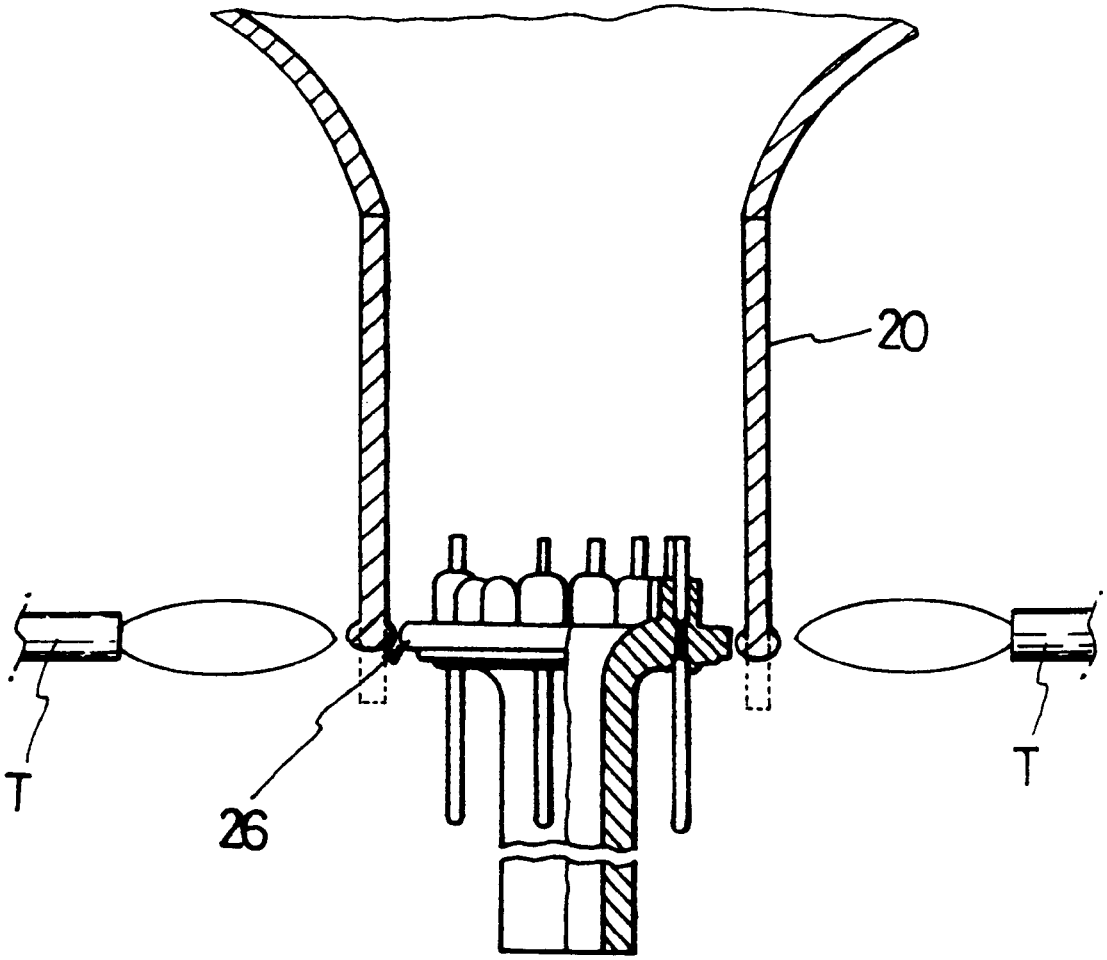
FIG. 1B is a cross sectional view of the neck and stem of the CRT showing a state in which the bottom end of the neck is fused and shrinks upward according to the first preferred embodiment.
Figure 2:
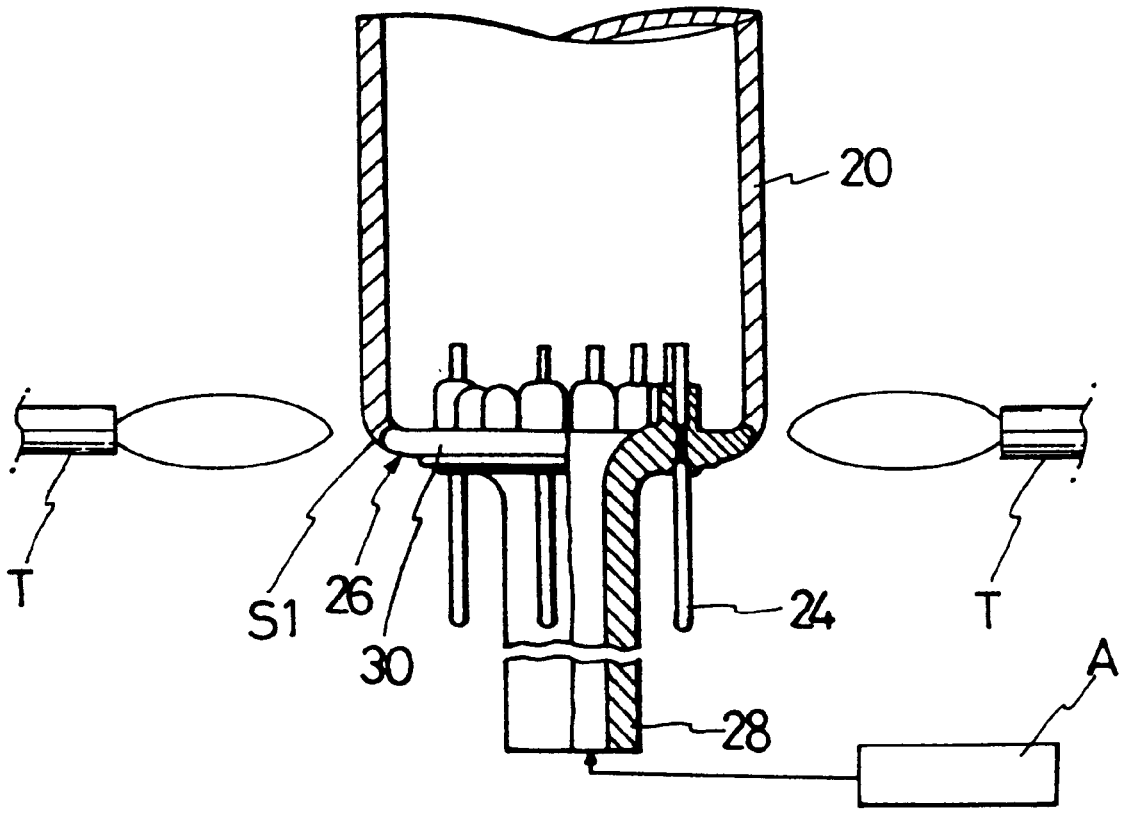
FIG. 2 is a cross sectional view of the neck and stem of the CRT showing a state in which the neck and stem are bonded together in such a manner as to provide a vacuum-tight seal between them according to the first preferred embodiment.

The reason that the position of the flange is determined as above is because the end portion of the neck, as shown in FIG. 1B, is fused and shrinks upward during the heating operation, and the shrinkage distance is twice the thickness of the flange to the maximum. And in such a way, the inside of the neck can be protected from the heat generated during the heating operation.

Preferably, the bottom side of the flange is in a position on the inside of the neck, 0.3~0.8 mm distant from the bottom end of the neck.

In such a state, the stem 26 and neck 20 is heated using a torch T till they are fused to be thereby sealed together.

Accompanying with the sealing operation, the stem 26 is pulled downward so as to elongate the sealed portion of the neck 20, thereby forming curved portions S1 between the stem 26 and neck 20.

The reason of moving the stem 26 downward opposite to the neck 20 is because the inner and outer surfaces of the bottom end of the neck are deflated during the heating operation and the deflated portions have bad effects on the CRT manufacturing process. That is, the deflated outer surface of the neck is an obstacle to the step of mounting a deflection yoke on the neck while the deflated inner surface of the neck contacts protrusions for protecting the stem pins 24, thereby causing a crack.

In the method according to the first preferred embodiment, the bottom end of the neck is directly sealed to the stem without any waste-disposed portion so that a glass powder produced by the broken glass is not generated, thereby removing one of the serious defects in the CRT processing, called a beam-guide hole clogging defect of the shadow mask.

Moreover, the method further includes a step of ventilating a compressed air into the inside of the neck 20 through the exhaust pipe 28 during the sealing operation. The exhaust pipe 28 is connected to a compressed air generating unit A to receive the compressed air therefrom. The compressed air is applied on the inner surface of the neck to thereby prevent it from being deflated during the heating operation. Thus, even when the bottom end of the neck is heated, its inner surface does not make in contact with the protrusions of the stem pins, thereby preventing occurrence of the crack.

Figure 3:
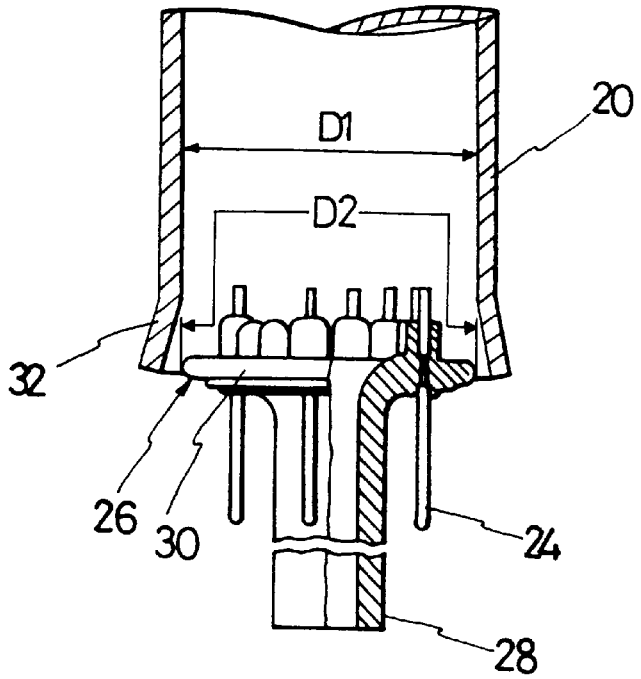
FIG. 3 is a cross sectional view of a neck and stem of the CRT before performing a sealing operation according to a second preferred embodiment of the present invention.
Figure 4:
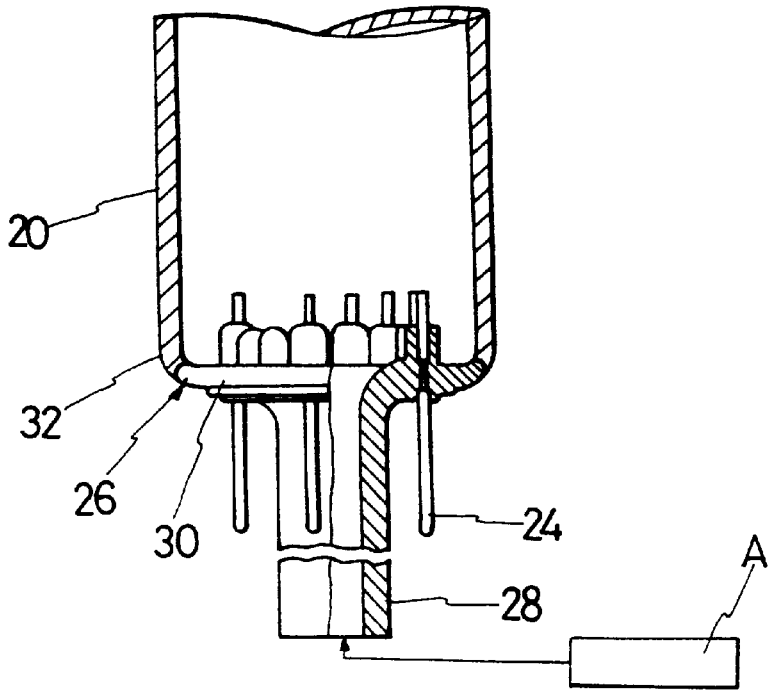
FIG. 4 is a cross sectional view of the neck and stem of the CRT showing a state in which the neck and stem are bonded together in such a manner as to provide a vacuum-tight seal between them according to the second preferred embodiment.

A second embodiment of the present invention will be now described with reference to FIGS. 3 and 4, wherein like numbers designate elements that are identical to those described in the first preferred embodiment. In this preferred embodiment, the bottom portion of the neck 20 is steadily enlarged to thereby form a enlarged opening portion 32 and the outer diameter D2 of the flange 30 is larger than the inner diameter D1 of the neck 20 except the enlarged opening portion 32. That is, the diameter of the neck is reduced while the outer diameter of the flange is enlarged. In such a way, the inner surface of the neck 20 does not make in contact with the protrusions of the stem pins 24 even during the heating operation.

The method according to the second preferred embodiment of the present invention solves the problems raised in the previously cited Japanese Patent Laid Open No. 8-83582 while realizing the same object as of the patent, additional to the effects obtained in the first preferred embodiment.

In the aforementioned method, the stem 26 is positioned on the inside of the enlarged opening portion 32 such that the upper side of the stem flange 30 is positioned above the bottom end of the enlarged opening portion 32. Then, the enlarged opening portion 32 and the flange 30 are heated till they are fused to be thereby sealed together.

The subsequent sealing operational steps are performed in the same way as in the first preferred embodiment.

Figure 5:
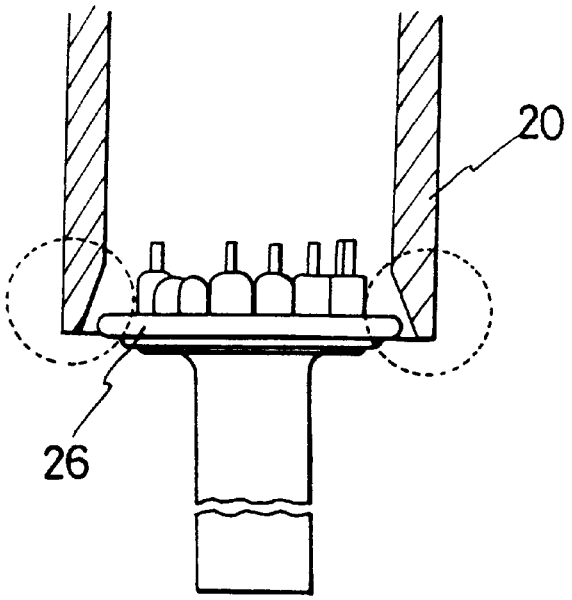
FIG. 5 is a cross sectional view of a neck and stem of the CRT before performing a sealing operation according to a third preferred embodiment of the present invention.
Figure 6:
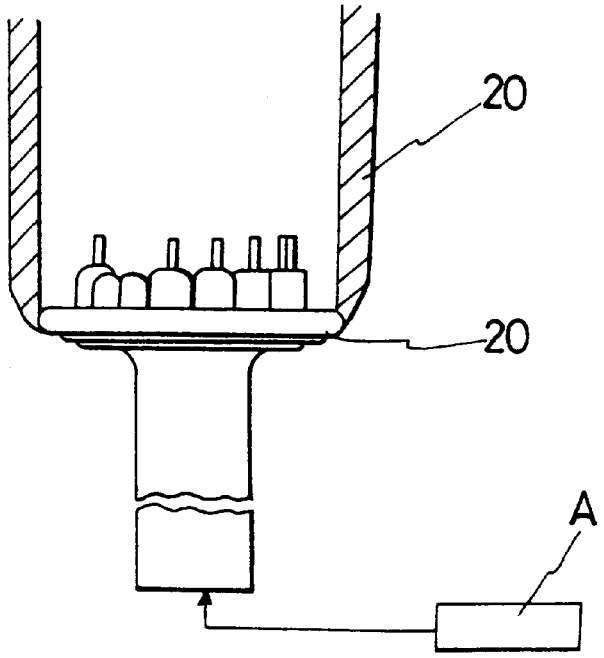
FIG. 6 is a cross sectional view of a neck and stem of the CRT showing a state in which the neck and stem are bonded together in such a manner as to provide a vacuum-tight seal between them according to the third preferred embodiment.
Figure 7:
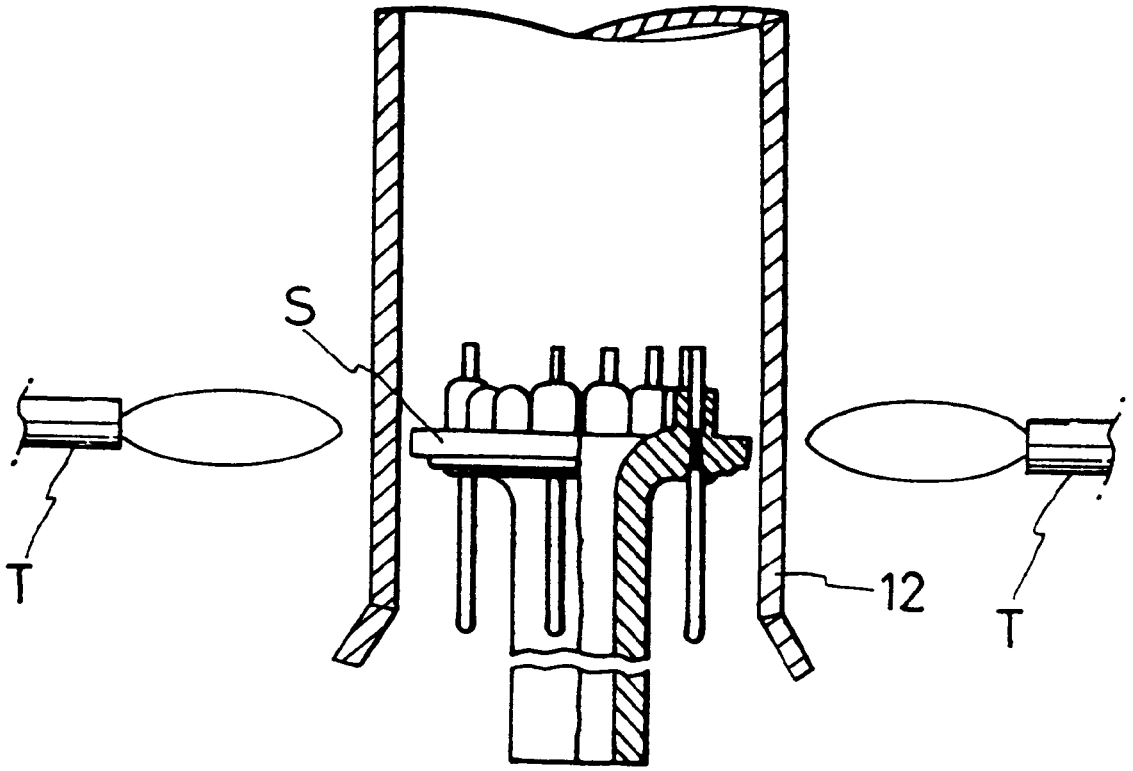
FIG. 7 is a cross sectional view of a neck and stem of the CRT before performing a sealing operation according to a conventional method.
Figure 8:
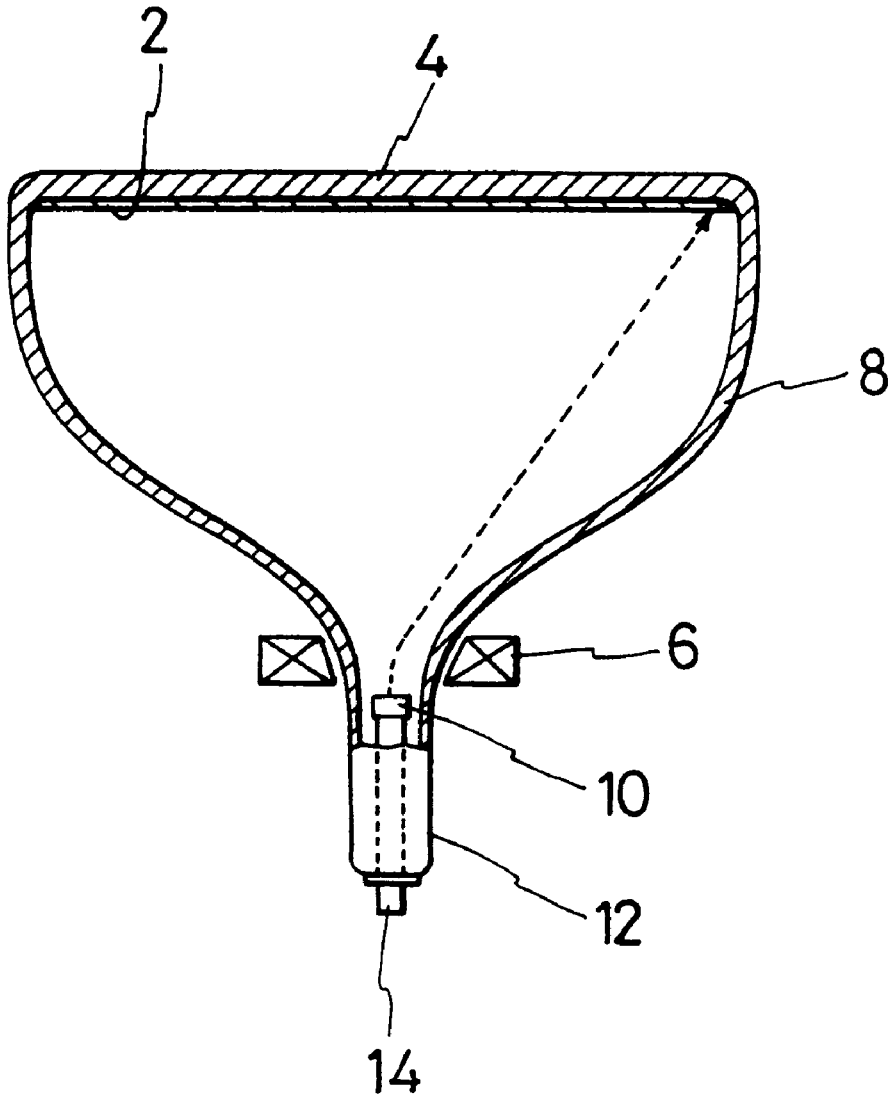
FIG. 8 is a schematic cross sectional view of the generally well-known CRT, In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawing and description are to be regarded as illustrative in nature, and not as restrictive.

A third preferred embodiment of the present invention is shown in FIGS. 5 and 6, wherein like numbers designate elements that are identical to those described in the previous embodiments. In this preferred embodiment, the outer diameter of the neck 20 is uniform all the way from its top end to the bottom end. However, the inner diameter of the neck 20 is steadily enlarged in the opening portion. Accordingly, the effects previously described in the second preferred embodiment can be also obtained in this preferred embodiment.

In addition to the advantages described above, in the inventive CRT, power consumption for driving the CRT is reduced by minimizing the diameter of the neck. Furthermore, the additional step of removing the gap between the stem and neck during the sealing operation, which is necessary for the conventional CRT processing, is not needed in the inventive CRT manufacturing process. Accordingly, the number of the CRT processing steps can be also reduced.

It will be apparent to those skilled in the art that various modifications and variations can be made in the CRT and the method of manufacturing the same of the present invention without departing from the spirit or scope of the invention. Thus, it is intended that the present invention cover modifications and variations of this invention provided they come within the scope of the appended claims and their equivalents.

What is claimed is:

1. A cathode ray tube comprising:

a panel having a phosphor screen;

a funnel bonded together with the panel in a vacuum-tight manner;

a neck connected to the funnel in the rear; and a stem mounting an electron gun thereon and having a flange, the flange being sealed to the neck, wherein a bottom end of the neck has an inner diameter larger than an outer diameter of the flange, and a sealing operation between the neck and the flange is performed in such a state that a bottom side of the flange is in a position, externally distant from the bottom end of the neck less than a thickness of the flange while internally distant from the bottom end of the neck less than twice the thickness of the flange.

2. The cathode ray tube of claim 1, wherein the sealing operation is performed in such a state that the bottom side of the flange is in a position on the inside of the neck, the position being 0.3~0.8 mm distant from the bottom end of the neck thereto.

3. The cathode ray tube of claim 1, wherein the sealing operation is performed in such a state that the bottom end of the neck is positioned above the bottom side of the flange while below an upper side of the flange.

4. The cathode ray tube of claim 1, wherein the stem is pulled downward during the sealing operation so as to elongate the sealed portion of the neck, thereby preventing the sealed portion of the neck from being deflated.

5. The cathode ray tube of claim 1, wherein the inner diameter of the neck is uniformly formed all the way from a top end of the neck to the bottom end.

6. The cathode ray tube of claim 1, wherein the bottom end of the neck comprises an enlarged opening portion, the enlarged opening portion having a steadily enlarging diameter.

7. The cathode ray tube of claim 1, wherein the bottom end of the neck comprises an enlarged opening portion, the enlarged opening portion having an uniform outer diameter and a steadily enlarging inner diameter.

8. A method of manufacturing a cathode ray tube, the method comprising the steps of:

providing a stem with a flange having an outer diameter smaller than an inner diameter of a bottom end of a neck;

performing a sealing operation between the stem and the neck in such a state that a bottom side of the flange is in a position, externally distant from the bottom end of the neck less than a thickness of the flange while internally distant from the bottom end of the neck less than twice the thickness of the flange; and moving the stem downward during the sealing operation so as to elongate the sealed portion of the neck, thereby preventing the sealed portion of the neck from being deflated.

9. The method of claim 8, wherein the sealing operation is performed in such a state that the bottom side of the flange is in a position on the inside of the neck, the position being 0.3~0.8 mm distant from the bottom end of the neck thereto.

10. The method of claim 8, wherein the sealing operation is performed in such a state that the bottom end of the neck is positioned above the bottom side of the flange while below an upper side of the flange.

11. The method of claim 8, further comprising a step of providing a compressed air into the inside of the cathode ray tube through an exhaust pipe of the stem.

12. The method of claim 8, wherein the inner diameter of the neck is uniformly formed all the way from a top end of the neck to the bottom end.

13. The method of claim 8, wherein the bottom end of the neck comprises an enlarged opening portion, the enlarged opening portion having a steadily enlarging diameter.

14. The method of claim 8, wherein the bottom end of the neck comprises an enlarged opening portion, the enlarged opening portion having an uniform outer diameter and a steadily enlarging inner diameter.

* * * * *